US006435833B1

(12) United States Patent
Reluzco et al.

(10) Patent No.: US 6,435,833 B1
(45) Date of Patent: Aug. 20, 2002

(54) BUCKET AND WHEEL DOVETAIL CONNECTION FOR TURBINE ROTORS

(75) Inventors: George Ernest Reluzco, Schenectady; Rong-Shi Paul Chiu, Glenmont; Bijan Omidvar, Niskayuna, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/774,070

(22) Filed: Jan. 31, 2001

(51) Int. Cl.[7] ..... F01D 5/32
(52) U.S. Cl. ..... 416/222; 416/239; 416/248
(58) Field of Search ..... 416/216–218, 416/219 R, 220 R, 222, 239, 248

(56) References Cited

U.S. PATENT DOCUMENTS 4,824,328 A * 4/1989 Pisz et al. ..... 416/219 R
5,299,915 A 4/1994 Dinh et al.
5,474,423 A 12/1995 Seeley et al.
5,494,408 A * 2/1996 Seeley et al. ..... 416/222
5,531,569 A * 7/1996 Seeley ..... 416/222
6,142,737 A 11/2000 Seeley et al.

* cited by examiner

*Primary Examiner*—Christopher Verdier
(74) *Attorney, Agent, or Firm*—Banner & Witcoff, Ltd.

(57) ABSTRACT

A multiple hook dovetail connection for connecting a rotor wheel and a bucket for a turbine rotor that permits the use of wider vanes at the ends of the buckets without changing the size of the wheel and the other existing components of the turbine. The dovetail connection comprises a male dovetail component and a female dovetail component. The male dovetail component includes a plurality of hooks. Each of the hooks includes a crush surface, a neck and an angle formed between the crush surface and the neck. These books are dimensioned in accordance with at least one of the included tables.

15 Claims, 5 Drawing Sheets

BUCKET AND WHEEL DOVETAIL CONNECTION FOR TURBINE ROTORS

TECHNICAL FIELD

The present invention relates to steam turbine rotors, and more particularly to dovetail connections between steam turbine rotor wheels and steam turbine buckets.

BACKGROUND OF THE INVENTION

Dovetail connections between turbine rotor wheels and turbine buckets include wheel hooks and bucket hooks that cooperate with each other to counter the centrifugal forces that are imposed on the connections. These hooks also prevent the buckets from separating from their wheel during the operation of the steam turbine. However, a major failure potential for conventional dovetail connections is their margin for creep. This is especially true in high pressure (HP) sections of the turbine where high temperatures are produced. For a bucket and wheel dovetail connection in a turbine operating at operational temperature of between about 850 to 1000 degrees Fahrenheit and at given stress levels, the creep strength of the bucket and rotor materials is not equal. Instead, the strength of the wheel is less than that of the bucket. As a consequence of the material strength differences and the load distribution that occurs during operation, the lower strength wheel limits the magnitude of the stresses that the connection can withstand. If the stresses exceed the material strength of the wheel, creeping will occur and the connection may fail. The limitations created by the configuration and dimensions of these conventional connections and the dependence of these connections on the lower material strength of the wheel prevent conventional turbines from reaching optimal levels of performance.

Commonly assigned U.S. Pat. No. 5,474,423 to Seeley et al. discloses a bucket and wheel dovetail connection for steam turbine rotors. In the Seeley et al. patent, the dovetail connection includes four hooks on the rotor wheel that have crush surfaces. The crush surfaces each form an angle with a respective neck surface that is greater than ninety degrees. The radially innermost hook includes a crush surface that is at an angle of ninety degrees to its respective neck surface. The slanted crush surfaces result in lower stress concentrations in the wheel hooks. Nevertheless, the need for optimization of a dovetail connection between a wheel and a bucket still existed.

These conventional dovetail connections cannot support a larger vane unless the size of the connection is also increased. Applying a larger vane would cause a turbine using conventional dovetail connections to fail. Alternatively, an increase in the overall size of the dovetail connections would result in an undesirable increase in the overall size of the turbine stages and an increase in the spacing of the turbine stages. These increases would require that the overall size of the steam turbine also be increased.

BRIEF SUMMARY OF THE INVENTION

It is desirable to overcome the drawbacks in the prior art by providing a dovetail connection that optimizes the joint between a rotor wheel and a bucket and permits the use of wider vanes at the ends of the buckets without changing the size of the wheel and the other existing components of the turbine. In an embodiment of the present invention, a dovetail connection for connecting a rotor wheel and bucket for a turbine comprises a male dovetail component and a female dovetail component. The male dovetail component includes a plurality of hooks. Each of the hooks includes a crush surface, a neck and an angle formed between the crush surface and the neck. These hooks are dimensioned in accordance with at least one of the below listed tables.

DETAILED DESCRIPTION OF THE INVENTION

The figures illustrate portions of a steam turbine rotor that include a bucket and wheel dovetail connection. Compared to conventional dovetail connections, the dovetail connection according to the present invention reduces the average and concentrated stresses in the bucket and wheel that result from centrifugal forces created during the operation of the turbine. For example, the geometry and dimensions of the hooks prevent excessive creeping at high temperatures. Also, the dovetail connection discussed below has a higher load carrying capacity when compared to existing dovetail connections with the same external dimensions. The dovetail connection permits at least 30% more load to be distributed to the bucket than to the wheel during the operation of the turbine. This distribution takes advantage of the greater material strength of the bucket material. This is especially advantageous in the portions of the turbine where the operating temperatures reach between about 850 and 1000 degrees Fahrenheit. Additionally, the distribution of the additional stresses to the bucket permits the use of larger blades within the size constraints of a conventional steam turbine. As a result, the performance of the turbine can be increased to an optimum level without increasing its overall size.

Figure 1:
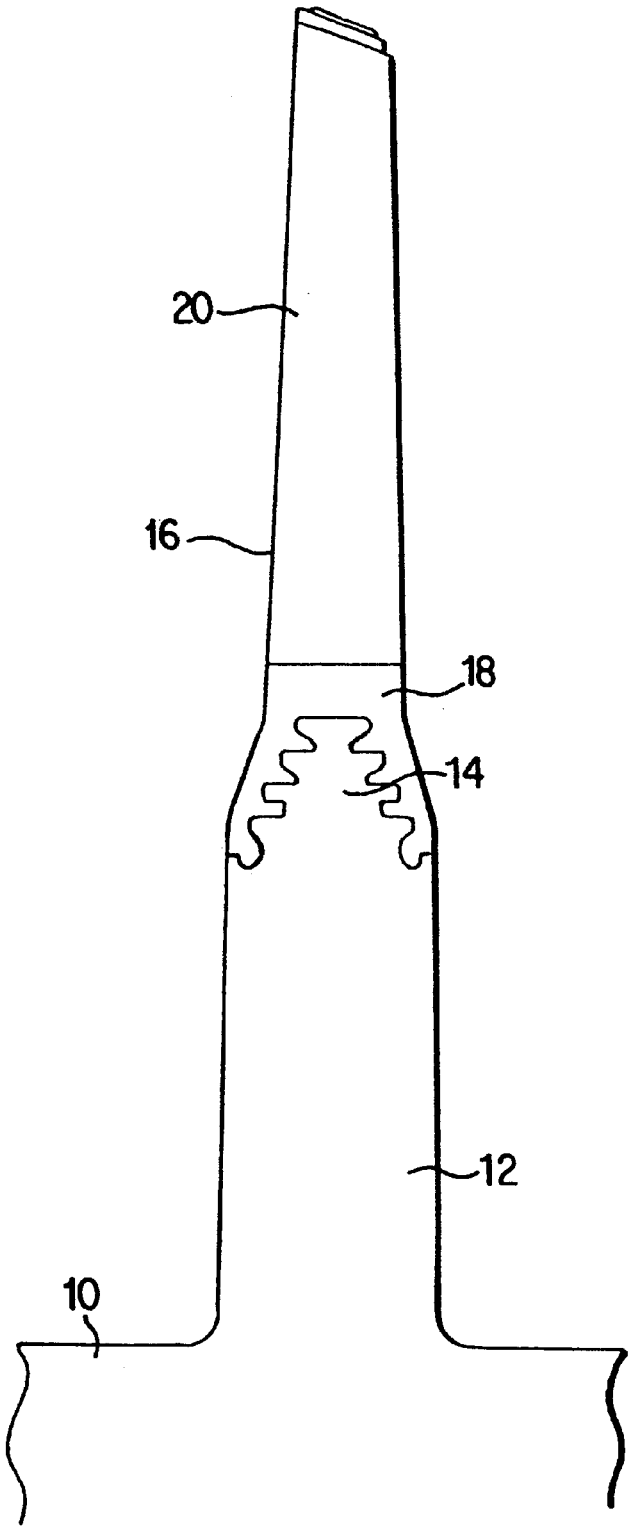
Fig. 1 PRIOR ART
FIG. 1 is a schematic representation of a conventional turbine rotor wheel and bucket dovetail joint.

FIG. 1 illustrates a portion of a steam turbine including a shaft 10 and a rotor wheel 12 secured to the shaft 10 in any well-known manner. Though not illustrated, the shaft 10 also includes additional rotor wheels that are spaced from each other along the length of shaft 10. Each rotor wheel 12 mates with a plurality of steam turbine buckets 16 that carry a blade as is known in the art. The material used to form the wheel 12 can include, but is not limited to, Chrome-Moly-Vanadium alloy steel. The materials used to form the bucket 16 can include, but are not limited to, stainless steels including a 12% chrome stainless steel.

For clarity, only wheel 12 and bucket 16 have been illustrated and described herein. However, the discussions relating to the wheel 12 and the bucket 16 are equally applicable to the other wheels and buckets positioned along the length of the shaft 10.

Figure 2:
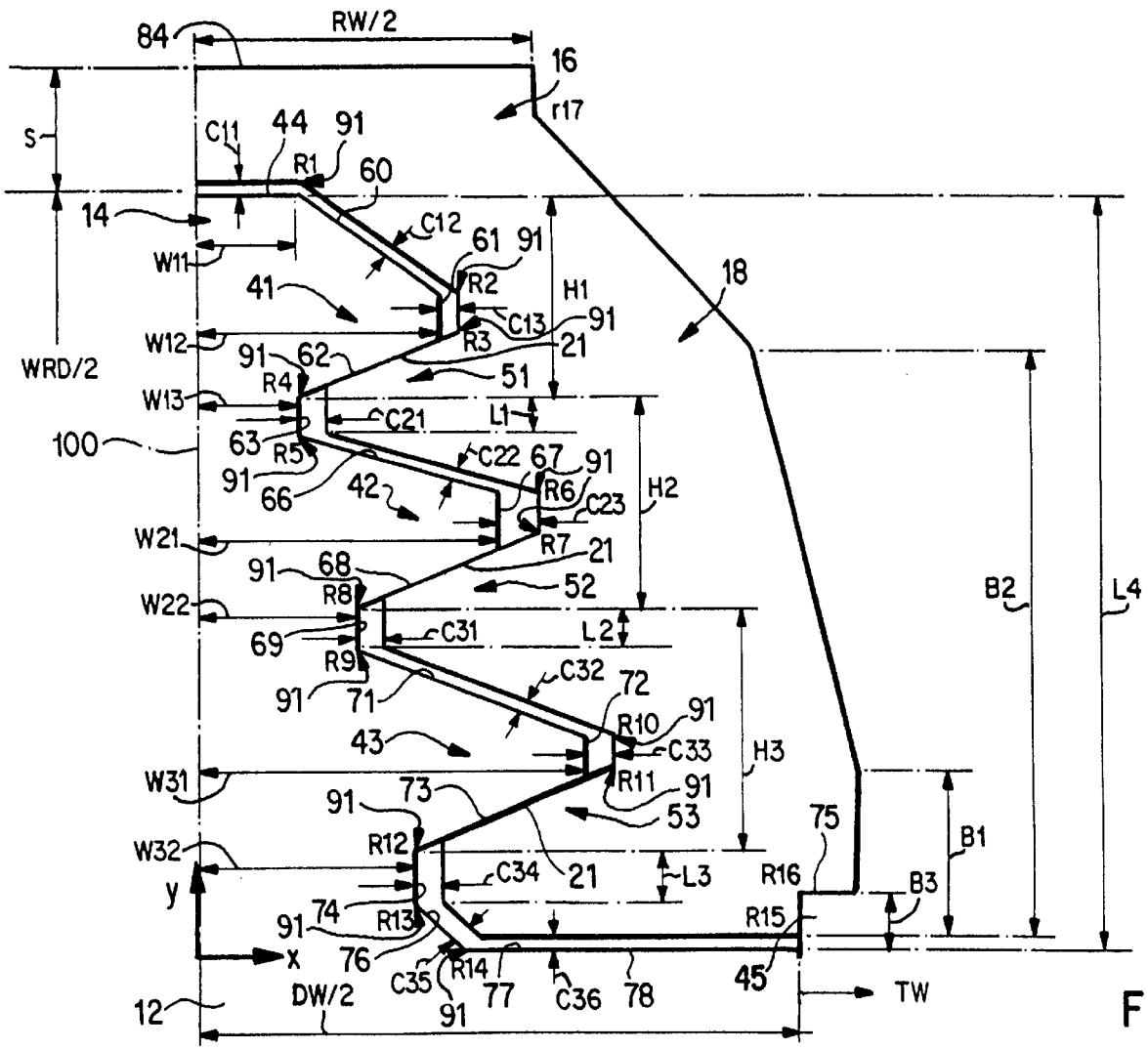
FIG. 2 is a partial cross-sectional view of a turbine wheel dovetail connection in accordance with the present invention.

An embodiment of the wheel 12 and bucket 16 is illustrated in FIG. 2. As discussed below, the embodiment shown in FIG. 2 includes three hooks. The geometry and dimensions of the hooks that add to the optimum performance of the turbine are discussed in the tables below.

As shown in FIG. 2, the rotor wheel 12 terminates along its outer radius in a male dovetail component 14. The male dovetail component 14 includes a plurality of hooks 41, 42, 43 and a tang 45. A turbine bucket 16 including a female dovetail component 18 is shown positioned on the wheel 12. The female dovetail component 18 includes a plurality of hooks 51, 52, 53 that extend along the innermost portion of the bucket 16 for mating with the hooks 41–43, respectively, of the male dovetail component 14. The bucket 16 also includes a blade 20 that extends away from the female dovetail component 18. In one embodiment, the dovetail connection includes a tangential entry-type dovetail arrangement.

As illustrated in FIG. 2, the first hook 41 is furthest away from the centerline of the shaft 10. The second hook 42 is spaced between the first hook 41 and the third hook 43. As clearly shown, the third hook 43 is closest to the centerline of the shaft 10.

Figure 4:
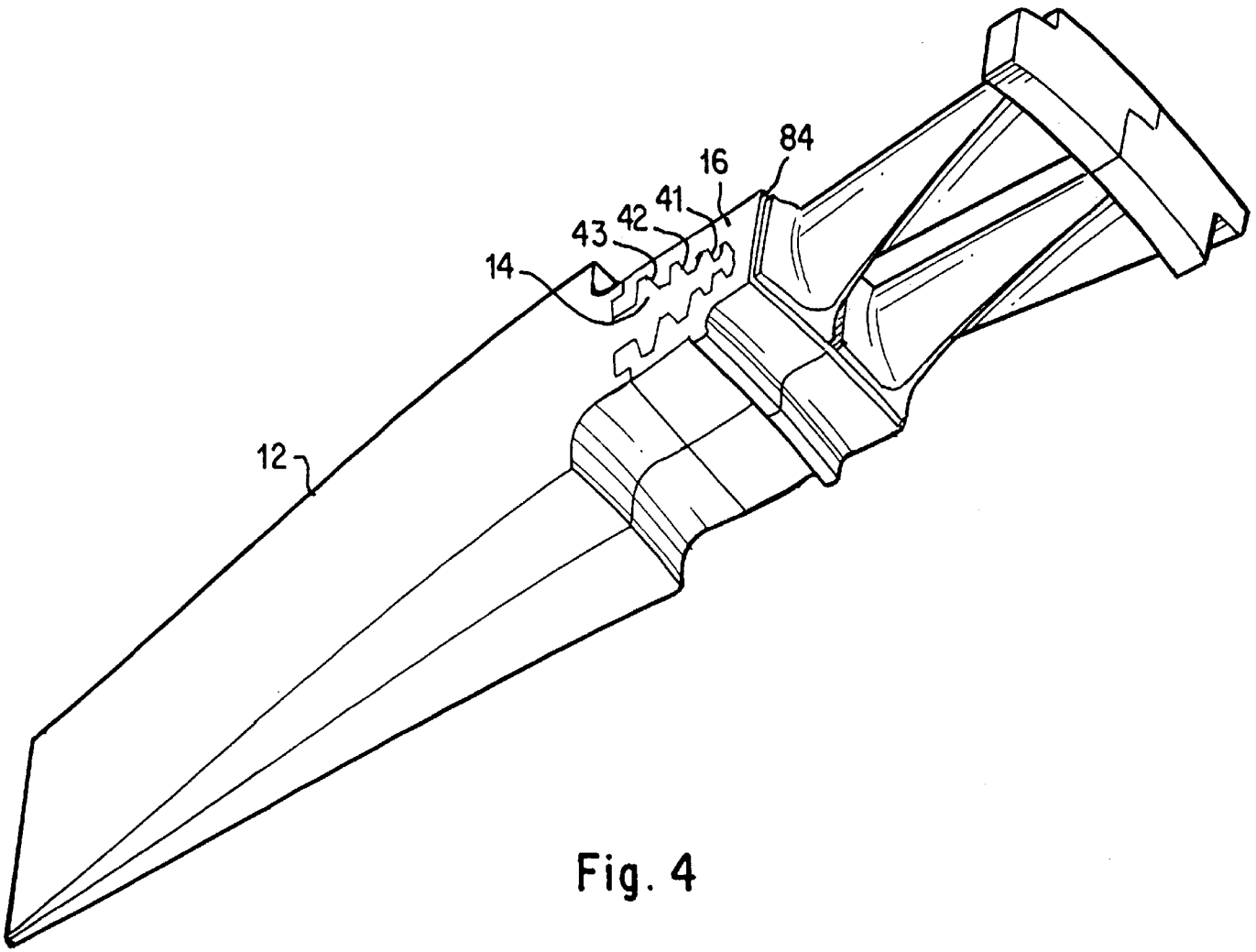
FIG. 4 is a perspective view of the dovetail connection.

In the ensuing description, it will be appreciated that the dovetail hooks 41–43 of the male component 14 and the hooks 51–53 of the female component 18 are symmetric with respect to a radial plane 100 that extend normal to the axis of rotation of the shaft 10. Also, it is accepted practice to refer only to half the dovetail hooks 41–43 and 51–53 of the components 14, 18, i.e., the dovetail hooks along one side of the radial plane 100. Thus, the description of the embodiment illustrated in FIG. 2 refers to the three hooks 41–43 and three hooks 51–53 along one side of the radial plane 100 that is parallel to and coextensive with the mid-plane, which includes the axis of symmetry, of the wheel 12 that extends in the direction of the bucket 16. It is understood by one of skill in the art that the hooks 41–43 and 51–53 form only a portion of the dovetail joint and that each component 14, 18 of the dovetail joint includes six hooks as shown in FIG. 4.

Figure 3:
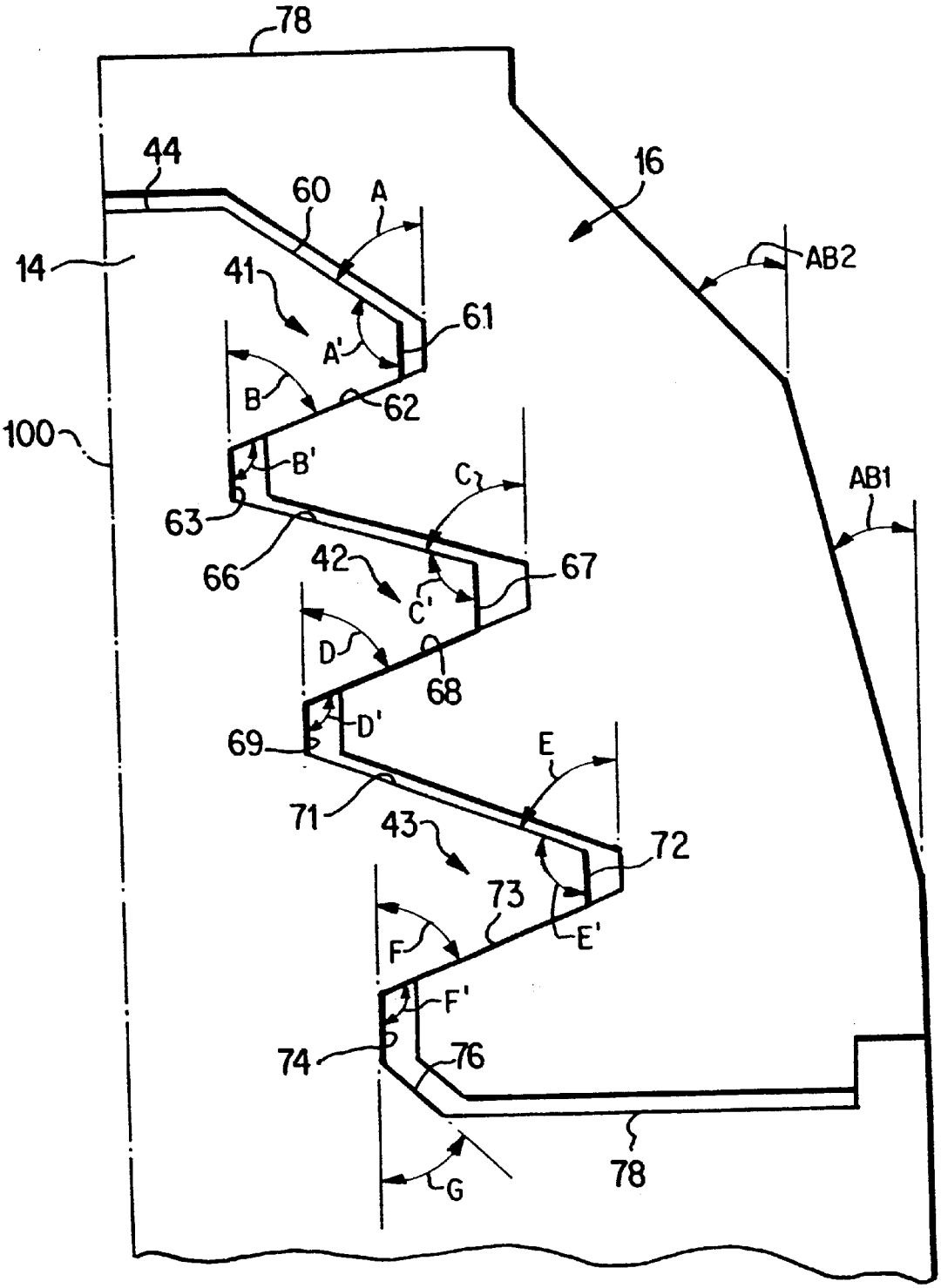
FIG. 3 is an enlarged fragmentary cross-sectional view of the hooks of the dovetail connection of FIG. 2.

Above the first hook 41, the wheel 12 includes an end surface 44 having a width of about 0.2975 inch. End surface 44 can also be referred to as the wheel rim surface. The width according to the present invention extends in an axial direction. The width extends from the radial plane 100 to an upper surface 60 of the first hook 41. The upper surface 60 extends between the end surface 44 and an upper hook face 61. The upper surface 60 is slanted relative to plane 100 so that it forms an angle A' with the upper hook face 61. FIG. 3 illustrates that angle A' is equal to 180 degrees minus angle A. Angle A is the angle formed between the upper surface 60 and a plane that is parallel to the upper hook face 61. As shown in FIG. 2, the upper hook face 61 extends substantially parallel to the plane 100.

A contact surface 62 extends between the face 61 and a neck 63 of the first hook 41. The contact surface 62 is slanted at an obtuse angle relative to the face 61. The neck 63 extends substantially parallel to plane 100 and at an angle B' to the contact surface 62. Angle B' is equal to 180 degrees minus angle B. As shown in FIG. 3, angle B is defined as the angle between the contact surface 62 and a line that extends parallel to the plane 100 and the neck 63 in the direction away from the neck 63 and toward end surface 44.

The second hook 42 includes an upper surface 66 that extends between the neck 63 of the first hook 41 and a hook face 67. The upper surface 66 is slanted relative to the plane 100 so that it forms an angle C' with the second hook face 67. FIG. 3 illustrates that angle C' is equal to 180 degrees minus angle C. Angle C extends between upper surface 66 and the second hook face 67. As is shown in FIG. 2, the second hook face extends substantially parallel to the plane 100.

A contact surface 68 of the second hook 42 extends between the second hook face 67 and a neck 69 of the second hook 42. As seen in FIG. 3, the contact surface 68 extends at an obtuse angle to the hook face 67. Like the neck 63, the neck 69 extends substantially parallel to the plane 100 and at an angle D' to the contact surface 68. Angle D' is equal to 180 degrees minus angle D. As shown in FIG. 3, angle D is defined as the angle between the contact surface 68 and a line that extends parallel to plane 100 and the neck 69 in the direction away from the neck 69 and toward end surface 44.

The third hook 43 is similar to the first two 41, 42. The hook 43 includes an upper surface 71 that extends between and is slanted relative to the neck 69 and a hook face 72. Like the other hook faces, the hook face 72 extends substantially parallel to the plane 100. As a result, the upper surface 71 forms an angle E' with the hook face 72 as shown in FIG. 3. Angle E' equals 180 degrees minus angle E. As illustrated, angle E is defined in a manner similar to angle A and angle C.

The third hook 43 also includes a contact surface 73 that extends between the hook face 72 and a neck 74. The contact surface 73 intersects with the hook face 72 at an obtuse angle. Like the other necks, the neck 74 extends substantially parallel to plane 100 and at an angle F' to the contact surface 73. Angle F' is equal to 180 degrees minus angle F. As shown in FIG. 3, angle F is defined as the angle between the contact surface 73 and a line that extends parallel to plane 100 and the neck 74 in the direction away from the neck 74 and toward end surface 44.

The third hook further includes a surface 76 that extends between the neck 74 and an upper surface 77 of a shoulder 78 of the wheel 12. The surface 76 extends at an angle relative to the neck 74 of 180 degrees minus angle G. Angle G extends between surface 76 and a plane that is coextensive with neck 74 and that extends away from neck 74 in the direction of the shaft 10. Although it is shown as being at a slight angle to the neck 74, the surface 76 is extended substantially parallel to the neck 74.

The shoulder 78 includes the tang 45 at its outer edge. The shoulder 78 and tang 45 can provide support for the bucket when the turbine is not operating. Additional support is also provided by the upper surfaces 60, 66, 71 of each hook. As understood from the figures, when the turbine is at rest, the upper surfaces 60, 66, 71 each contact a cooperating surface on the bucket 16 to support the bucket 16 on the wheel 12.

Figure 5:
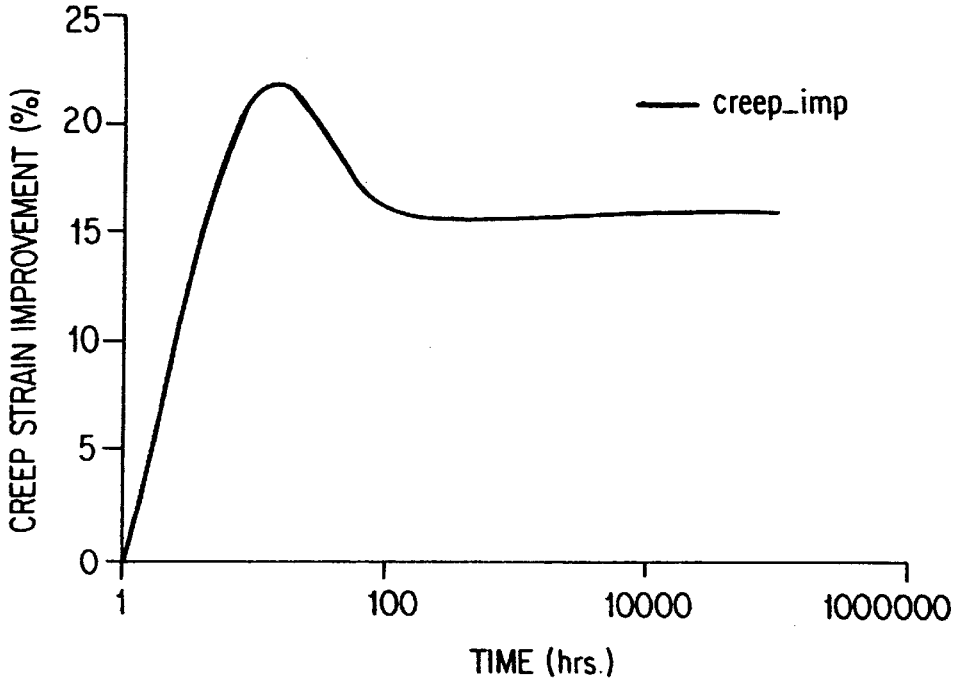
FIG. 5 is a graph showing the improvement in resisting creep experienced by the dovetail connection described herein.
Figure 6:
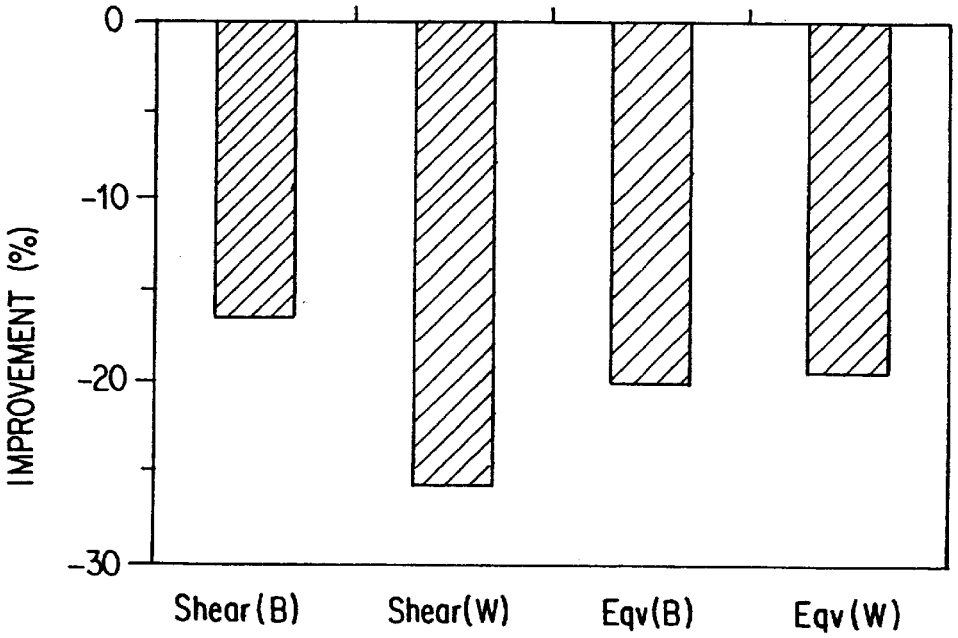
FIG. 6 is a chart showing the reduction in shear stresses and equivalents in wheel and bucket hooks described herein.

During the operation of the turbine, the centrifugal forces generated by the rotation of the wheel 12 causes the contact surfaces 62, 68 and 73 to engage with a contact surface 21 on the cooperating hooks 51–53 of the bucket 16 in order to prevent the separation of the wheel 12 and the bucket 16. These contact surfaces 62, 68, 73 and 21 are commonly referred to as crush surfaces. Concentrated stresses result when load paths are forced to change directions abruptly. Accordingly, the slanted crush surfaces 62, 68, 73 and 21, having the configuration described herein, cause a less severe change in direction and hence afford lower stress concentrations in the wheel 12. Additionally, these slanted crush surfaces 62, 68, 73 and 21 transfer the stresses to the bucket 16 that, as discussed above, has a stronger material strength than the wheel 12 when the turbine is operating at temperatures of 850 to 1000 degrees Fahrenheit. By transferring the stresses to the bucket 16, the elastic shear stresses in the hooks 41–43, creep deformation (due to high temperature environment of high pressure stages) and stress concentrations within the wheel 12 are reduced relative to the prior art as shown by the creep improvement graph of FIG. 5. Moreover, a percentage of reduction in the shear and equivalent stresses in the: wheel and bucket hooks as compared to conventional dovetail connections is shown in FIG. 6.

The connection of the present invention permits the load on the bucket 16 to be increased by about 30% or greater. An increased load can include the application of a larger blade 20 on the end of the bucket 16. Larger blades 20 can be used with the present invention without the size of the wheel 12, the bucket 16 or the dovetail connection being increased. The use of a larger blade will improve the performance of the turbine.

In order to reduce the stress concentrations at the intersection of adjacent surfaces of the dovetail connection, each crush surface 62, 68 and 73 is spaced from its respective neck 63, 69 and 74 and face 61, 67 and 72 by fillets 91. The radii of these fillets 91 are listed below in table VI. The radii of these fillets 91 result in a further lowering of the concentrated stresses in the wheel 12 and the bucket 16 at the dovetail connection when combined with the other dimensions and features of the present invention. The radii of fillets R1–R12 are substantially equal to those used in conventional connections of this type. These fillets have radii of either 0.125 inch or 0.075 inch. As noted previously, slanted crush surfaces cause a component of force in the axial direction which gives rise to the bending of the bucket leg and an axial load on the tang 45 of the wheel dovetail. To minimize this effect, the hook thickness (height) H of all of the hooks is substantially the same as shown in the tables below.

As shown in FIG. 2, the height of each hook H is the distance from the beginning of its upper surface to the juncture between the crush surface for the hook and its neck. As also shown, the height L of each wheel neck is the distance between the juncture of its crush surface and the neck and the juncture of the neck and the beginning of an upper surface for an adjacent hook.

The magnitudes of the above-discussed angles are listed below in Table I. These angles and the dimensions discussed herein for the parameters of the dovetail connection were found to contribute to the optimum performance of the turbine by, at least, taking advantage of the increased material strength of the bucket 16 and reducing the stresses along the crush surfaces as discussed above.

Other dimensions relating to the disclosed exemplary embodiments are also disclosed in the tables below. These dimensions have a tolerance of +/− one ten-thousandths of an inch. These dimensions include the wheel neck width W for each surface of the hook. As seen in FIG. 2, the wheel neck width W for a given surface is the distance that the surface is spaced from the plane 100 on one side of the wheel 12.

The below listed dimensions also include the clearance C between the surfaces of the wheel hooks and the surfaces of the bucket hooks during the operation of the turbine. The clearances C11, C13, C21, C23, C31, C33 and C34 between certain surfaces that do not contact each other during the operation of the turbine are substantially the same. These surfaces include the necks of the wheel hooks and the faces of the bucket hooks. These similar clearances have been referenced collectively in the tables below as Ca. Similarly, the clearances C12, C22, C32 and C35 for the upper surfaces of the wheel hooks that do not contact the lower surfaces of the bucket hooks are substantially the same. As a result, they have been referenced collectively in the tables below as Cb.

The heights from the bottom of the bucket 16 to the illustrated intersections of different sections of the bucket 16 are also included in the tables below and shown in FIG. 2. Similarly, the angles formed by the surfaces of these sections with a plane extending parallel to the plane 100 are included in Table I.

Other dimensions include the distance DW/2 from the plane 100 to the outer surface of the bucket 16. This distance is about 1.4 inches for an embodiment according to the present invention. The illustrated height S of the bucket 16 above surface 44 to the blade securing surface 78 is about 0.9 inch. The radial distance RW/2 from the plane 100 to the outer edge of the bucket is about 1.4 inches. Other dimensions such as the wheel rim diameter (WRD) can be the same as found with a conventional dovetail connection. As understood in the art, the wheel rim diameter is twice the distance from a point to the axis of rotation of the shaft.

TABLE I

| Angle | Degrees |
|---|---|
| A | 80 |
| A' | 100 |
| B | 65 |
| B' | 115 |
| C | 80 |
| C' | 100 |
| D | 65 |
| D' | 115 |
| E | 80 |
| E' | 100 |
| F | 90 |
| F' | 90 |
| G | 0 |
| AB1 | 20 |
| AB2 | 20 |

TABLE II

| Bucket Dimensions | Inches |
|---|---|
| B1 | 1 |
| B2 | 1.01 |
| B3 | 0.25 |

TABLE III

| Clearance Between the Wheel and the Bucket | Inches |
|---|---|
| C36 | 0.02 |
| Ca | 0.017 |
| Cb | 0.027 |

TABLE IV

| Hook Height | Inches |
|---|---|
| H1 | 0.48 |
| H2 | 0.68 |
| H3 | 0.57 |

TABLE V

| Wheel Neck Height | Inches |
|---|---|
| L1 | 0.2 |
| L2 | 0.15 |
| L3 | 0.15 |
| L4 | 2.113 |

TABLE VI

| Fillets 91 | Radii (inches) |
|---|---|
| R13 | 0.219 |
| R14 | 0.075 |
| R15 | 0.075 |
| R16 | 0.075 |
| R17 | 0.25 |

TABLE VII

| Distances From Plane 100 | Inches |
|---|---|
| W11 | 0.2975 |
| W12 | 0.5035 |
| W13 | 0.3085 |
| W21 | 0.7725 |
| W22 | 0.5 |
| W31 | 1.0475 |
| W32 | 0.8525 |

With the foregoing dimensions, it will be appreciated that the dovetail shape minimizes concentrated stresses, while maintaining an overall size compatible with existing steam paths. While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims. For example, the male hooks could be positioned on the bucket and the female hooks on the wheel.

We claim:

1. A dovetail connection for connecting a rotor wheel and a bucket of a turbine rotor, said connection comprising: a male dovetail component and a female dovetail component, said male dovetail component comprising three hooks, each said hook including a crush surface, a neck and an angle formed between each said crush surface and a respective one of said necks, at least two of the angles being greater than ninety degrees and the hooks each having a height in accordance with Table IV.

2. The dovetail connection according to claim 1 wherein one of said at least two angles is greater than 110 degrees.

3. The dovetail connection according to claim 2 wherein said one of said at least two angles is about 115 degrees.

4. The dovetail connection according to claim 1 wherein said hooks each include a hook face and an upper surface, and wherein the hook face of each hook extends at an angle of greater than 90 degrees to a respective one of the upper surfaces.

5. The dovetail connection according to claim 4 wherein said crush surfaces and upper surfaces of said hooks are each spaced from a radial plane in accordance with a respective one of dimensions W11, W12, W21 and W31 of Table VII.

6. A dovetail connection between a rotor wheel and a bucket of a turbine rotor, said dovetail connection comprising a male dovetail component and a female dovetail component, said mail dovetail component comprising a plurality of hooks each having a height and a wheel neck height in accordance with Tables IV and V.

7. The dovetail connection according to claim 6 wherein said hooks include a plurality of surfaces that are spaced from a radial plane extending through the center of the wheel in accordance with Table VII.

8. The dovetail connection according to claim 6 wherein said hooks include a plurality of surfaces extending at angles relative to each other in accordance with Table I.

9. The dovetail connection according to claim 8 wherein the surfaces of said hooks are spaced from a radial plane extending through the center of the wheel in accordance with Table VII.

10. A dovetail connection for connecting a rotor wheel and a bucket of a turbine rotor, said dovetail connection comprising: a male dovetail component and a female dovetail component, said male dovetail component comprising a plurality of hooks for cooperating with hooks on said female dovetail component, each said hook of said male dovetail component including a crush surface and a neck, each said neck being spaced from a radial plane extending through the center of the wheel in accordance with a respective one of dimensions W13, W22 and W32 of Table VII.

11. The dovetail connection according to claim 10 wherein each crush surface extends at an angle to a respective one of the necks.

12. The dovetail connection according to claim 11 wherein at least one of said angles is greater than 110 degrees.

13. The dovetail connection according to claim 12 wherein the at least one of said angles is about 115 degrees.

14. The dovetail connection according to claim 10 wherein said hooks each include a hook face and an upper surface, and wherein the hook face of each hook extends at an angle of greater than 90 degrees to a respective one of the upper surfaces.

15. The dovetail connection according to claim 14 wherein the hooks have a height in accordance with Table IV.

* * * * *